US011803140B2

(12) United States Patent
Izumichi et al.

(10) Patent No.: US 11,803,140 B2
(45) Date of Patent: Oct. 31, 2023

(54) IMAGE FORMING APPARATUS

(71) Applicant: KYOCERA Document Solutions Inc., Osaka (JP)

(72) Inventors: Sachio Izumichi, Osaka (JP); Takehiro Sato, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/069,085

(22) Filed: Dec. 20, 2022

(65) Prior Publication Data

US 2023/0195013 A1 Jun. 22, 2023

(30) Foreign Application Priority Data

Dec. 22, 2021 (JP) ..... 2021-207797

(51) Int. Cl.
*G03G 15/20* (2006.01)
*G03G 21/16* (2006.01)

(52) U.S. Cl.
CPC ..... *G03G 15/2035* (2013.01); *G03G 15/2064* (2013.01); *G03G 21/1685* (2013.01); *G03G 2215/2032* (2013.01); *G03G 2221/1684* (2013.01)

(58) Field of Classification Search
CPC ..... G03G 15/2032; G03G 15/2035; G03G 21/1685; G03G 2221/1684
See application file for complete search history.

(56) References Cited

U.S. PATENT DOCUMENTS 5,049,945 A * 9/1991 Fukano ..... G03G 21/1623 399/122
7,505,713 B2 * 3/2009 Lee ..... G03G 15/2035 399/122
8,824,926 B2 * 9/2014 Egi ..... H05B 6/145 399/329
2006/0147226 A1 * 7/2006 Sato ..... G03G 21/1685 399/122
2010/0178088 A1 * 7/2010 Koshida ..... G03G 15/2032 399/328
2014/0255065 A1 * 9/2014 Takahashi ..... G03G 15/2064 399/329

(Continued)

FOREIGN PATENT DOCUMENTS

JP 2021086093 A 6/2021

*Primary Examiner* — Sevan A Aydin
(74) *Attorney, Agent, or Firm* — Alleman Hall Creasman & Tuttle LLP

(57) ABSTRACT

A heating unit urging member urges a first support body of a heating unit toward a second support body of a fixing unit with elastic force. The heating unit urging member brings the first support body into contact with the second support body and brings the second support body into contact with two struts. An interlocking mechanism moves the heating unit along a direction in which the heating unit and the fixing unit are arranged, in conjunction with movement of an operation portion. When the operation portion moves from a first position to a second position, the interlocking mechanism moves the first support body from a reference position where the first support body is in contact with the second support body to a retracted position where the first support body is separated from the second support body.

7 Claims, 9 Drawing Sheets

(56) References Cited

U.S. PATENT DOCUMENTS

| | | | | |
|---|---|---|---|---|
| 2014/0369730 | A1* | 12/2014 | Bayerle | G03G 21/1685 399/330 |
| 2016/0124382 | A1* | 5/2016 | Uehara | G03G 21/1685 399/122 |
| 2016/0202650 | A1* | 7/2016 | Yoshida | G03G 21/1685 399/88 |
| 2018/0032028 | A1* | 2/2018 | Watatani | G03G 21/1647 |
| 2018/0210382 | A1* | 7/2018 | Ishii | G03G 15/2035 |
| 2021/0165352 | A1* | 6/2021 | Sato | G03G 15/2064 |

* cited by examiner

IMAGE FORMING APPARATUS

INCORPORATION BY REFERENCE

This application is based upon and claims the benefit of priority from the corresponding Japanese Patent Application No. 2021-207797 filed on Dec. 22, 2021, the entire contents of which are incorporated herein by reference.

BACKGROUND

The present disclosure relates to an electrophotographic image forming apparatus including a heating unit and a fixing unit.

An electrophotographic image forming apparatus transfers a toner image from an image carrier to a sheet, and fixes the toner image on the sheet with a fixing device.

The fixing device may be divided into a heating unit including a heater and a fixing unit including a fixing member and a pressure roller. The heater heats the fixing member.

In addition, it is known that the image forming apparatus includes a mechanism for moving the heating unit from a heating position to a retracted position in conjunction with an operation on an operation portion. When the heating unit is retracted to the retracted position, the fixing unit can be pulled out from the main body.

SUMMARY

An image forming apparatus according to one aspect of the present disclosure includes a main body frame, a heating unit, and a fixing unit. The heating unit is supported by the main body frame. The fixing unit is disposed next to the heating unit and supported by the main body frame. The main body frame includes two struts and two beams. The two struts extend in a vertical direction beside the fixing unit and are spaced apart from each other in a first direction. The two beams extend in a lateral direction below the heating unit and the fixing unit, are spaced apart from each other in the first direction, and are coupled to the two struts, respectively. The fixing unit is disposed between the heating unit and the two struts. The heating unit includes a heater and a first support body. The first support body supports the heater and is placed on the two beams in a state of being bridged over the two beams. The fixing unit includes a fixing member, a pressure member, and a second support body. The fixing member is heated by the heater. The pressure member urges a sheet toward the fixing member. The second support body supports the fixing member and the pressure member and is placed on the two beams in a state of being bridged over the two beams. The image forming apparatus further includes an elastic heating unit urging member, an operating portion, and an interlocking mechanism. The heating unit urging member urges the first support body toward the second support body with elastic force so as to bring the first support body into contact with the second support body and bring the second support body into contact with the two struts. The operation portion is movable between a first position and a second position by being operated. The interlocking mechanism moves the heating unit along a second direction, which is a direction in which the heating unit and the fixing unit are arranged, in conjunction with movement of the operation portion. The interlocking mechanism moves the first support body from a reference position where the first support body is in contact with the second support body to a retracted position where the first support body is separated from the second support body when the operation portion moves from the first position to the second position. Further, the interlocking mechanism moves the first support body member from the retracted position to the reference position when the operation portion moves from the second position to the first position. The fixing unit is allowed to be pulled out from the main body frame in a removal direction along the first direction when the first support body is at the retracted position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment will be described with reference to the drawings. It is noted that the following embodiment is an example of embodying the present disclosure and does not limit the technical scope of the present disclosure.

Configuration of Image Forming Apparatus 10

An image forming apparatus 10 according to the embodiment executes print processing using an electrophotographic method. The print processing is processing for forming an image on a sheet 9.

Figure 1:
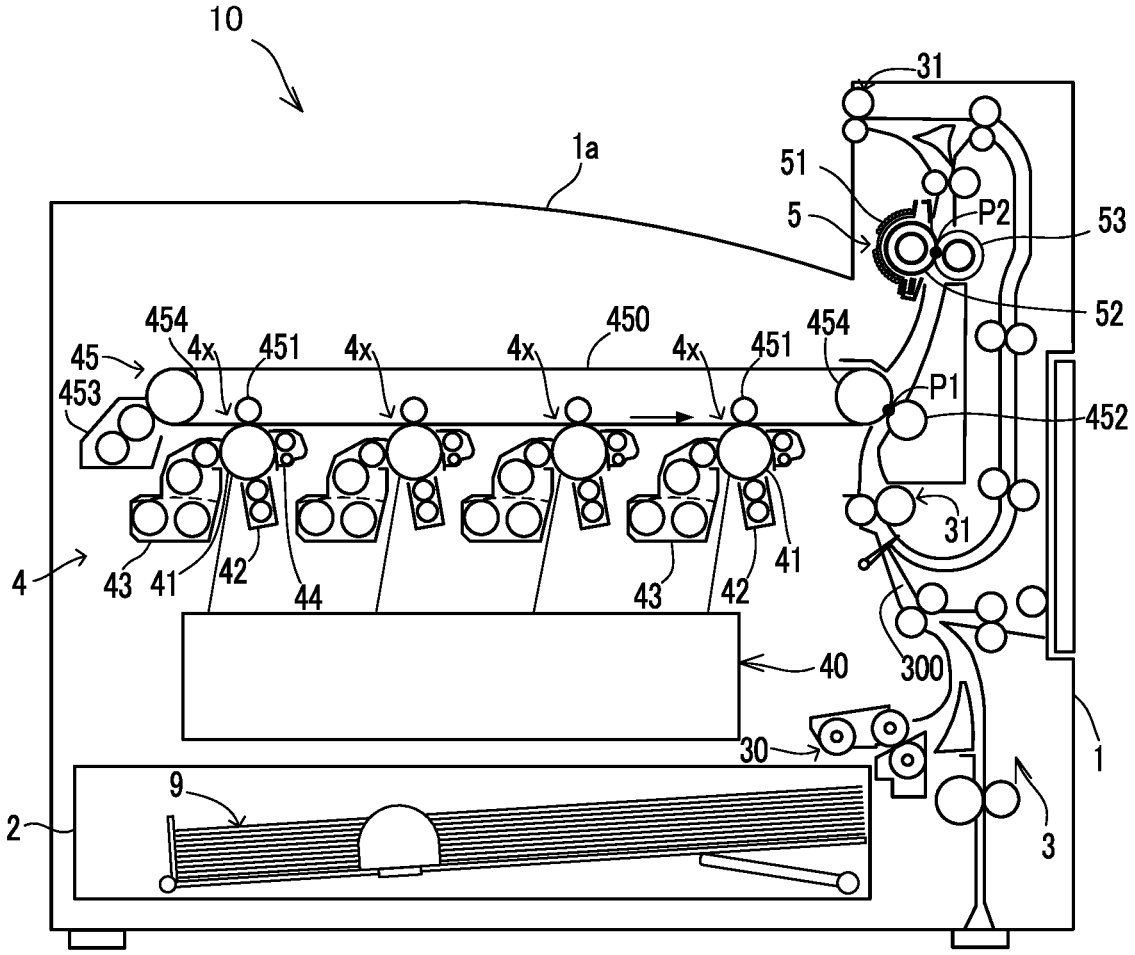
FIG. 1 is a configuration diagram of an image forming apparatus according to an embodiment.

As shown in FIG. 1, the image forming apparatus 10 includes a sheet storing portion 2, a sheet conveying device 3, and a printing device 4. The sheet conveying device 3 and the printing device 4 are housed in a main body portion 1 which is a housing.

The sheet storing portion 2 can house a plurality of sheets 9. The sheet conveying device 3 includes a sheet feeding device 30, and a plurality of conveying roller pairs 31.

The sheet feeding device 30 feeds the sheets 9 in the sheet storing portion 2 one by one to a conveying path 300. The conveying path 300 is a passage of the sheet 9.

The conveying roller pairs 31 convey the sheet 9 along the conveying path 300. One of the conveying roller pairs 31 discharges the sheet 9 on which an image has been formed from the conveying path 300 onto a discharge tray 10*a*.

The printing device 4 executes the print processing on the sheet 9 conveyed along the conveying path 300. The image formed on the sheet 9 is a toner image.

The printing device 4 includes a laser scanning unit 40, one or more image forming portions 4*x*, a transfer device 45, and a fixing device 5. The image forming portions 4*x* each include a photoconductor 41, a charging device 42, a developing device 43, and a drum cleaning device 44.

The charging device 42 charges the surface of the photoconductor 41. The laser scanning unit 40 scans the surface of the charged photoconductor 41 with a light beam. Thus, the laser scanning unit 40 forms an electrostatic latent image on the surface of the photoconductor 41.

The developing device 43 supplies toner to the surface of the photoconductor 41 to develop the electrostatic latent image into a toner image. The transfer device 45 transfers the toner image formed on the surface of the photoconductor 41 to the sheet 9.

The transfer device 45 transfers the toner image to the sheet 9 at a transfer position P1 on the conveying path 300.

In the present embodiment, the printing device 4 is a tandem type color printing device including a plurality of image forming portions 4*x*. In addition, the transfer device 45 includes an intermediate transfer belt 450, a plurality of primary transfer devices 451, a secondary transfer device 452, and a belt cleaning device 453.

In the example shown in FIG. 1, the printing device 4 includes four image forming portions 4*x* corresponding to four color toners of yellow, cyan, magenta, and black. The transfer device 45 includes four primary transfer devices 451 corresponding to the four image forming portions 4*x*.

The intermediate transfer belt 450 is rotatably supported by a plurality of support rollers 454. One of the support rollers 454 is rotated by being driven by a belt drive device (not shown). Thus, the intermediate transfer belt 450 rotates.

The primary transfer devices 451 transfer the toner images formed on the surface of the photoconductor 41 by the respective image forming portions 4*x* to the surface of the intermediate transfer belt 450. Thus, a composite toner image, in which the toner images of four colors are combined, is formed on the surface of the intermediate transfer belt 450.

The intermediate transfer belt 450 rotates while carrying the composite toner image. The secondary transfer device 452 transfers the composite toner image formed on the surface of the intermediate transfer belt 450 to the sheet 9 at the transfer position P1.

The drum cleaning device 44 removes primary waste toner from the surface of the photoconductor 41. The primary waste toner is toner remaining on a portion of the surface of the photoconductor 41 that has passed through the primary transfer device 451.

The belt cleaning device 453 removes secondary waste from the surface of the intermediate transfer belt 450. The secondary waste toner is toner remaining on a portion of the surface of the intermediate transfer belt 450 that has passed through the secondary transfer device 452.

The fixing device 5 heats and presses the composite toner image on the sheet 9 at a fixing position P2 on the conveying path 300. Thus, the fixing device 5 fixes the composite toner image on the sheet 9. The fixing position P2 is a position downstream of the transfer position P1 in the sheet conveying direction.

Figure 2:
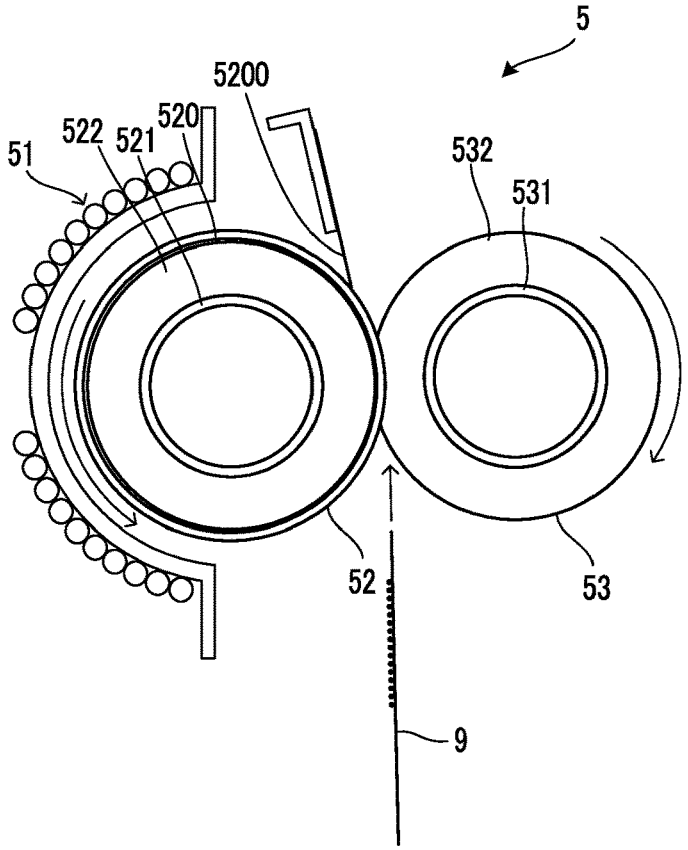
FIG. 2 shows a configuration of a main part of a fixing device in the image forming apparatus according to the embodiment.

As shown in FIG. 2, the fixing device 5 includes a heater 51, a fixing belt 52, a fixing roller 520, a pressure roller 53, and a sheet separating member 5200.

The fixing belt 52 is a flexible cylindrical member that encloses the fixing roller 520. The fixing belt 52 is heated by the heater 51.

The fixing roller 520 is a cylindrical member that supports the fixing belt 52 inside the fixing belt 52. The fixing roller 520 includes a cylindrical core metal portion 521 and an elastic portion 522 formed on the outer periphery of the core metal portion 521.

The fixing roller 520 is rotatably supported. The fixing belt 52 can rotate together with the fixing roller 520.

The fixing belt 52 includes a conductive base material, an elastic layer formed on the outer periphery of the base material, and a release layer formed on the outer periphery of the elastic layer.

The heater 51 is disposed to face the outer peripheral surface of the fixing belt 52. In the present embodiment, the heater 51 is an electromagnetic induction heating device. The heater 51 mainly heats the base material of the fixing belt 52 by electromagnetic induction.

The pressure roller 53 is rotatably supported. Like the fixing roller 520, the pressure roller 53 also includes a cylindrical core metal portion 531 and an elastic portion 532 formed on the outer periphery of the core metal portion 531.

The pressure roller 53 is rotated by being driven by a drive device (not shown). The fixing belt 52 and the fixing roller 520 rotate in conjunction with the pressure roller 53.

The fixing belt 52 heats the toner image formed on the sheet 9. The pressure roller 53 presses the toner image toward the sheet 9.

It is noted that the fixing belt 52 is an example of a fixing member heated by the heater 51. The pressure roller 53 is an example of a pressure member that urges the sheet 9 to the fixing belt 52.

When the sheet 9 adheres to the fixing belt 52, the sheet separating member 5200 peels the sheet 9 from the fixing belt 52.

Figure 4:
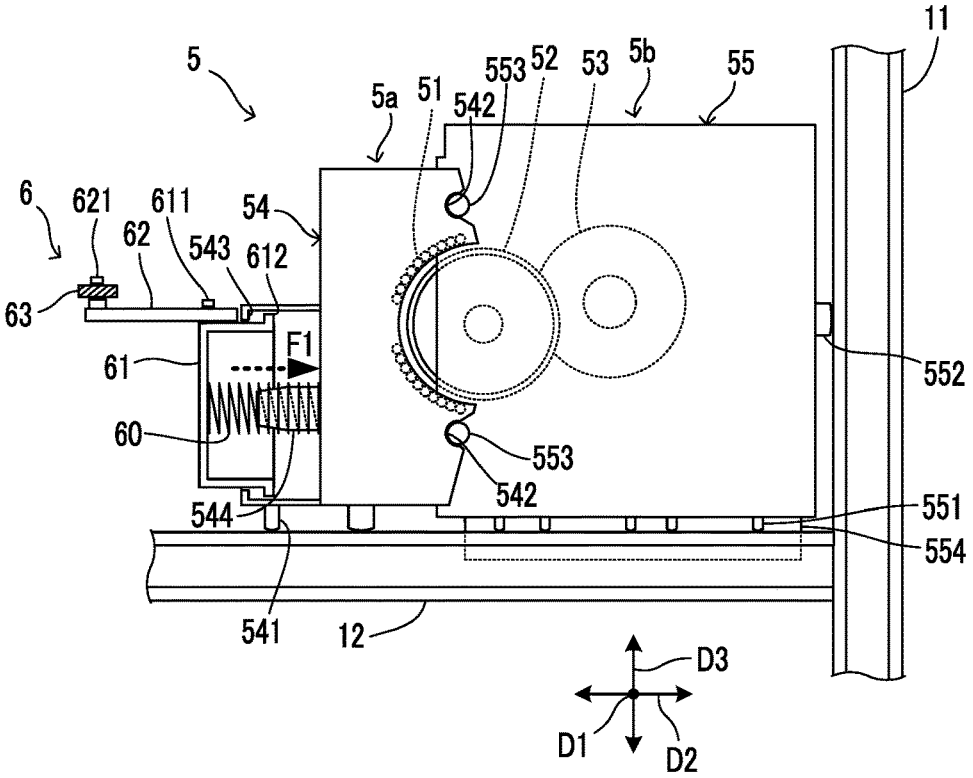
FIG. 4 is a front view of the fixing device and an interlocking mechanism in an urging state in the image forming apparatus according to the embodiment.
Figure 5:
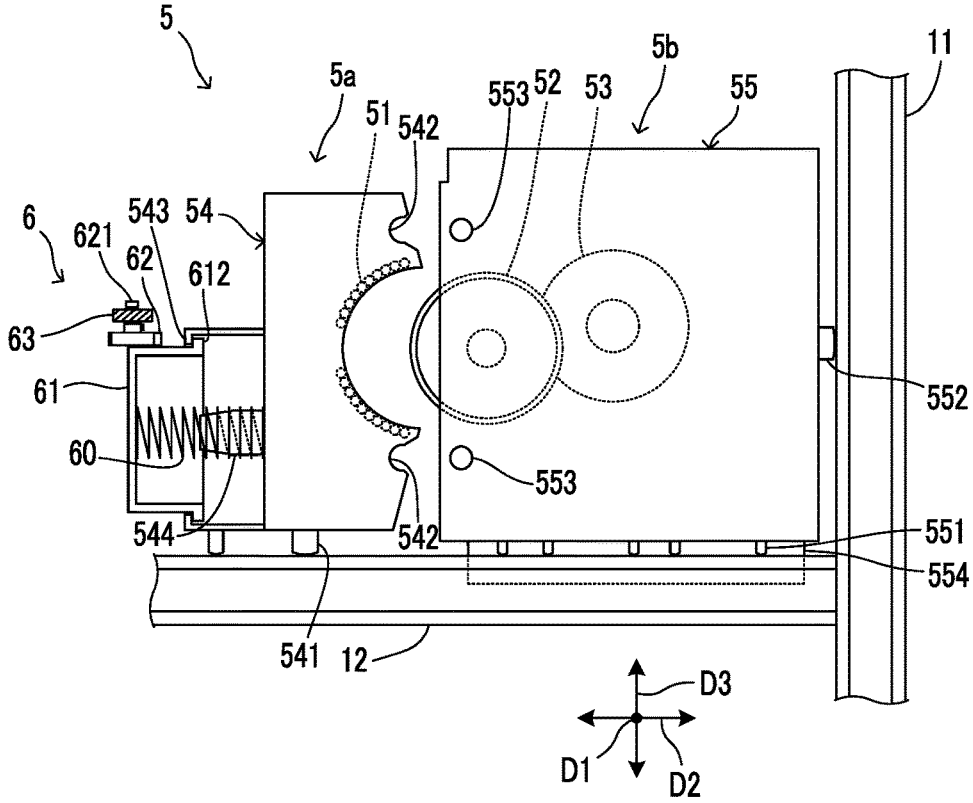
FIG. 5 is a front view of the fixing device and the interlocking mechanism in a retracting state in the image forming apparatus according to the embodiment.

In the present embodiment, the fixing device 5 is divided into a heating unit 5*a* and a fixing unit 5*b* (see FIG. 4 and FIG. 5). The heating unit 5*a* includes a heater 51 and a first support body 54. The fixing unit 5*b* includes the fixing belt 52, the fixing roller 520, the pressure roller 53, and a second support body 55.

The first support body 54 is a member that supports the heater 51. The second support body 55 is a member that supports the fixing belt 52, the fixing roller 520, and the pressure roller 53. The fixing belt 52 is supported by the second support body 55 via the fixing roller 520.

Figure 8:
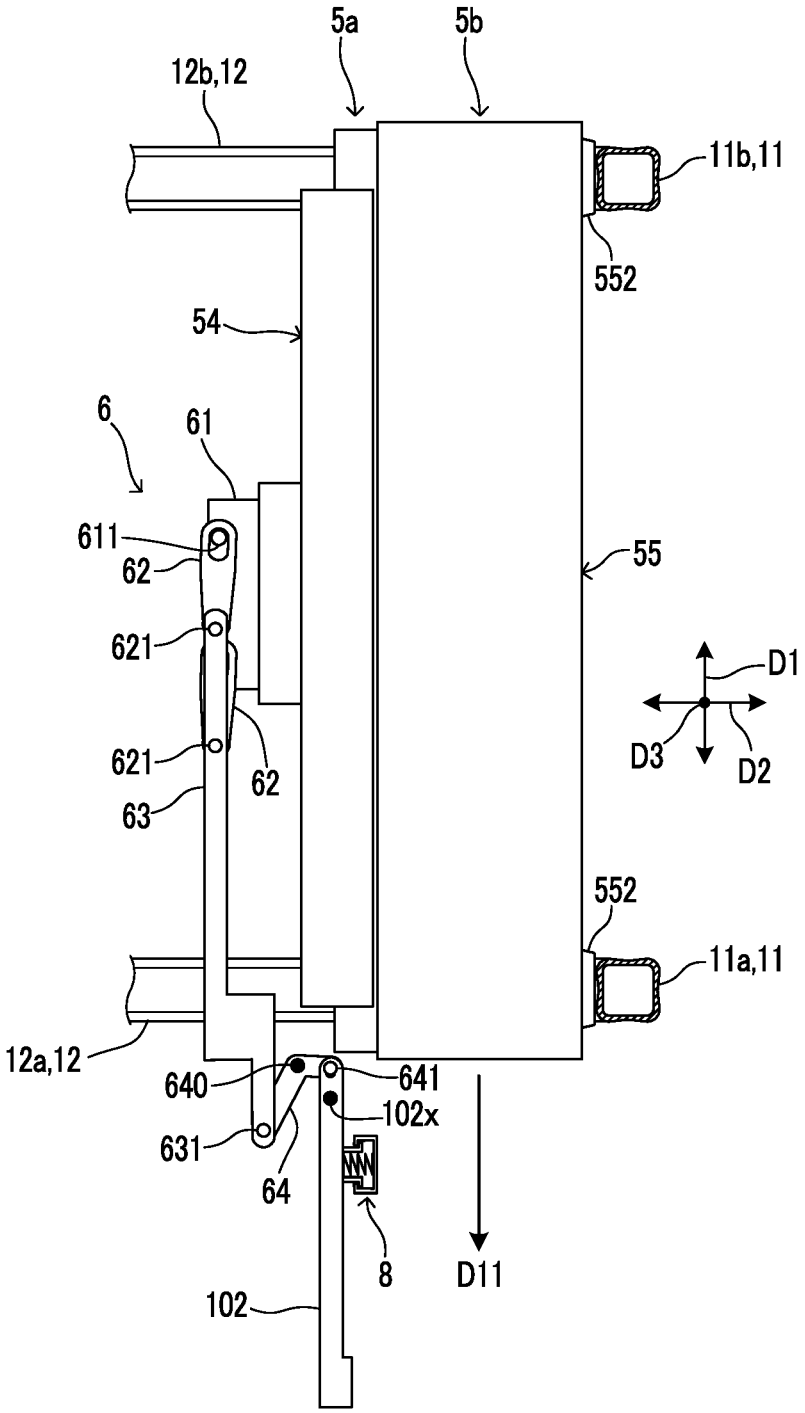
FIG. 8 is a plan view of the fixing device and the interlocking mechanism in the retracting state in the image forming apparatus according to the embodiment.

The fixing unit 5*b* can be pulled out from the main body portion 1 by moving the heating unit 5*a* away from the fixing unit 5*b* (see FIG. 5 and FIG. 8).

It is important to dispose the heater 51 at an appropriate position with respect to the fixing belt 52 in order to increase the heating efficiency of the fixing belt 52 by the heater 51.

When an electromagnetic induction heating device is employed as the heater 51, the accuracy of the position of the heater 51 is particularly important.

On the other hand, it is preferable that a unit positioning mechanism for disposing the heating unit 5*a* and the fixing unit 5*b* at desired positions is as simple as possible.

The unit positioning mechanism includes a mechanism for positioning the heating unit 5*a* at a reference position close to the fixing unit 5*b* and a mechanism for moving the heating unit 5*a* to a retracted position away from the fixing unit 5*b*.

The image forming apparatus 10 uses a simple mechanism to realize the mechanism for disposing the heating unit 5*a* and the fixing unit 5*b* at desired positions. Hereinafter, the mechanism for positioning the heating unit 5*a* and the fixing unit 5*b* will be described.

Mechanism for Positioning Heating Unit 5*a* and Fixing Unit 5*b*

Figure 3:
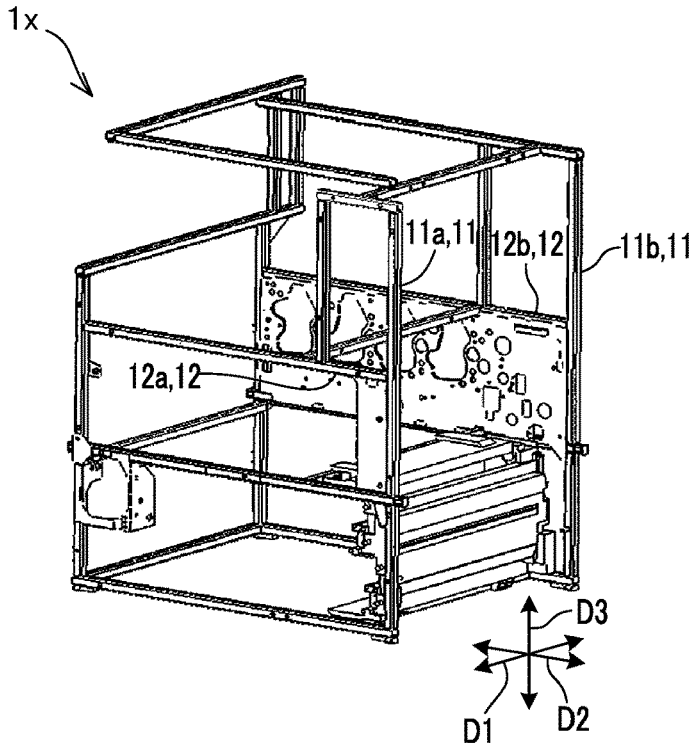
FIG. 3 is a perspective view of a main body frame in the image forming apparatus according to the embodiment.
Figure 9:
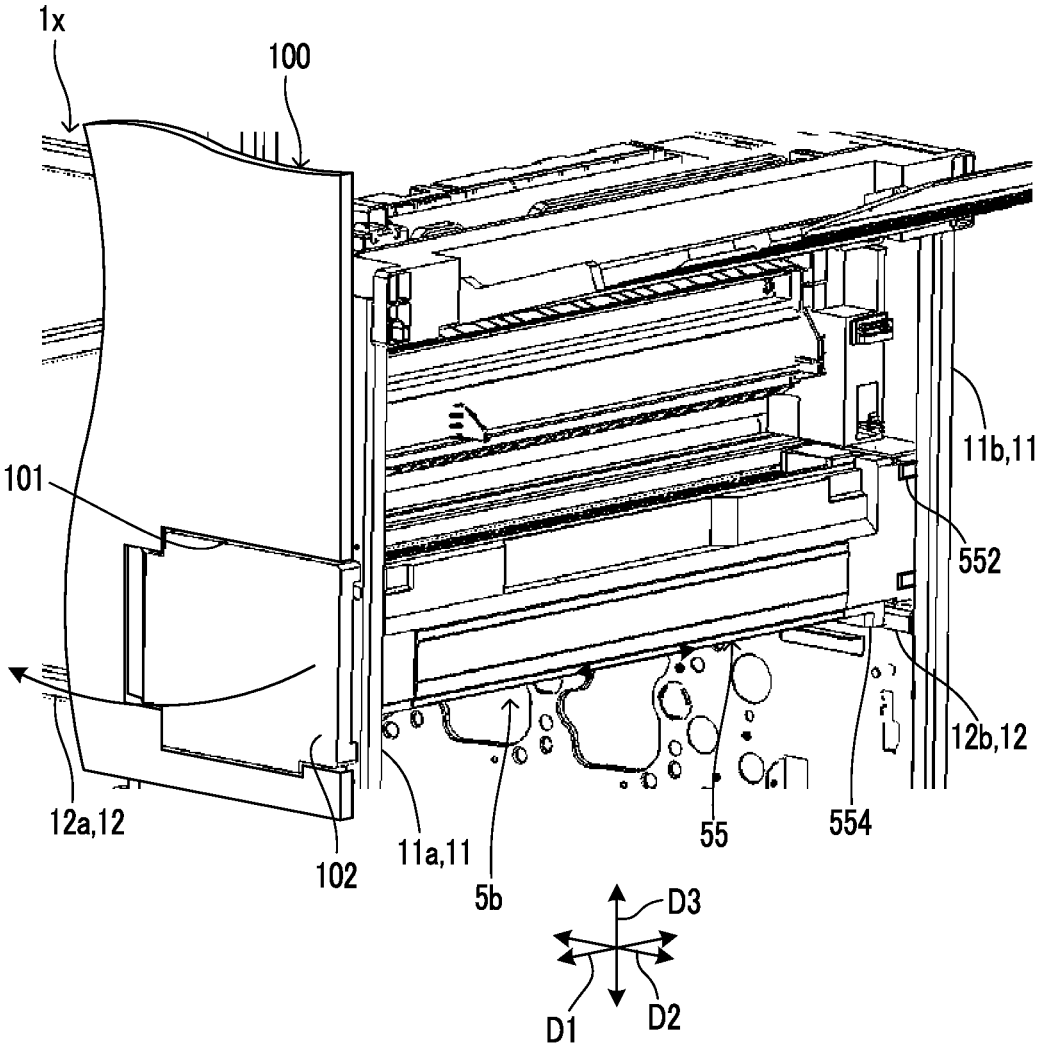
FIG. 9 is a perspective view of a peripheral portion of the fixing unit and a cover member in the image forming apparatus according to the embodiment.

The main body portion 1 of the image forming apparatus 10 includes a main body frame 1*x* and an exterior member 100 covering the main body frame 1*x* (see FIG. 3 and FIG. 9).

The main body frame 1*x* is composed of a combination of a plurality of metal pipes (see FIG. 3). The heating unit 5*a* and the fixing unit 5*b* are supported by the main body frame 1*x*. The fixing unit 5*b* is disposed next to the heating unit 5*a*.

The exterior member 100 is attached to the main body frame 1*x* (see FIG. 9). The exterior member 100 forms the exterior of the image forming apparatus 10.

The metal pipes constituting the main body frame 1*x* include two struts 11 and two beams 12 (see FIG. 3).

The two struts 11 extend in a vertical direction D3, and spaced apart from each other in a first direction D1 (see FIG. 3). The vertical direction D3 is an up-down direction.

The two struts 11 extend in the vertical direction D3 beside the fixing unit 5*b* (see FIG. 4 and FIG. 9).

The first direction D1 is also a direction along the rotational center lines of the fixing belt 52 and the pressure roller 53. In the present embodiment, the first direction D1 is the depth direction of the image forming apparatus 10.

The exterior member 100 has an opening portion 101 and a cover member 102 (see FIG. 9). The opening portion 101 is a portion where an opening for exposing one end of the fixing unit 5*b* in the first direction D1 is formed.

The cover member 102 is supported by a first support shaft 102*x*. Thus, the cover member 102 is rotatable around the first support shaft 102*x*. The cover member 102 is rotatable between a closed position to close the opening portion 101 and an open position to open the opening portion 101.

Figure 7:
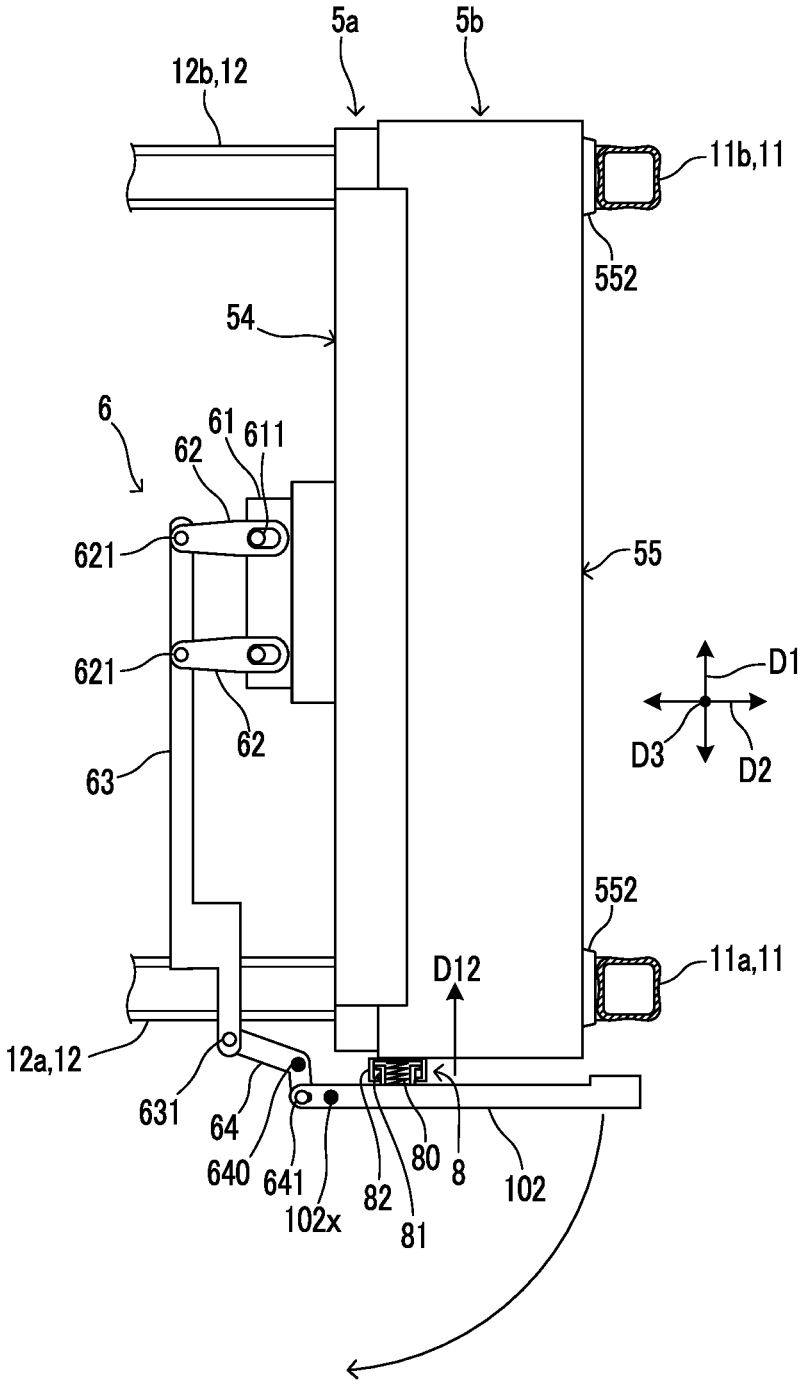
FIG. 7 is a plan view of the fixing device and the interlocking mechanism in the urging state in the image forming apparatus according to the embodiment.

FIG. 4 and FIG. 7 show the fixing device 5 when the cover member 102 is in the closed position. FIG. 5 and FIG. 8 show the fixing device 5 when the cover member 102 is in the open position.

When the cover member 102 is in the closed position, the cover member 102 is held in the closed position by a lock mechanism (not shown). When the lock by the lock mechanism is released, the cover member 102 can be rotated from the closed position to the open position.

The two struts 11 include a first strut 11*a* disposed on the front side of the image forming apparatus 10 and a second strut 11*b* disposed on the rear side of the image forming apparatus 10 (see FIG. 3).

The two beams 12 extend in a lateral direction below the heating unit 5*a* and the fixing unit 5*b*, and are spaced apart from each other in the first direction D1 (see FIG. 3 and FIG. 4). The lateral direction is the width direction of the image forming apparatus 10.

The two beams 12 are respectively coupled to the two struts 11 (see FIG. 3). For example, the two beams 12 are respectively coupled to the two struts 11 by welding.

The two beams 12 include a first beam 12*a* disposed on the front side of the image forming apparatus 10 and a second beam 12*b* disposed on the rear side of the image forming apparatus 10 (see FIG. 3).

The fixing unit 5*b* is disposed between the heating unit 5*a* and the two struts 11 (see FIG. 4).

The first support body 54 of the heating unit 5*a* is placed on the two beams 12 in a state of being bridged over the two beams 12. Similarly, the second support body 55 of the fixing unit 5*b* is placed on the two beams 12 in a state of being bridged over the two beams 12.

That is, neither the heating unit 5*a* nor the fixing unit 5*b* is fixed to the main body frame 1*x* by a fixing tool such as a screw.

The heating unit 5*a* and the fixing unit 5*b* are placed on the two beams 12 with their longitudinal directions aligned with the first direction D1 (see FIG. 7 and FIG. 8).

The heating unit 5*a* and the fixing unit 5*b* are arranged side by side in a second direction D2.

That is, the second direction D2 is a direction in which the heating unit 5*a* and the fixing unit 5*b* are arranged. The second direction D2 is a direction that intersects the first direction D1.

The image forming apparatus 10 further includes a first spring 60 and an interlocking mechanism 6 (see FIG. 4, FIG. 5, FIG. 7, and FIG. 8). For example, the first spring 60 is supported by a projection 544 that the first support body 54 has.

The first spring 60 urges the first support body 54 toward the second support body 55 with elastic force (see FIG. 4). The first spring 60 is an example of an elastic heating unit urging member.

The urging force F1 of the first spring 60 to the first support body 54 is greater than the static friction force of the heating unit 5*a* and the fixing unit 5*b* against the two beams 12.

The first support body 54 has a plurality of ribs 541 in contact with the upper surfaces of the two beams 12. Similarly, the second support body 55 has a plurality of ribs 551 in contact with the upper surfaces of the two beams 12. The ribs 541 of the first support body 54 and the ribs 551 of the second support body 55 are provided to reduce the static friction force.

The first spring 60 urges the first support body 54 to bring the first support body 54 into contact with the second support body 55. Further, the first spring 60 urges the first support body 54 to bring the second support body 55 into contact with the two struts 11. That is, the first spring 60 urges the second support body 55 via the first support body 54.

The first support body 54 has a plurality of concave first fitting portions 542 that open laterally (see FIG. 4 and FIG. 5). The first support body 54 has four first fitting portions 542 spaced apart in the first direction D1 and the vertical direction D3.

The second support body 55 has a plurality of convex second fitting portions 553 which can fit into the first fitting portions 542, respectively. The second support body 55 has four second fitting portions 553 corresponding to the four first fitting portions 542.

The first spring 60 urges the first support body 54 to bring the inner surfaces of the concave portions of the four first fitting portions 542 into contact with the four second fitting portions 553 (see FIG. 4).

In addition, by the second fitting portions 553 fitting into the first fitting portions 542, the relative movement of the first support body 54 and the second support body 55 in the vertical direction D3 is restricted.

It is noted that the second support body 55 may have the first fitting portions 542 and the first support body 54 may have the second fitting portions 553.

Figure 6:
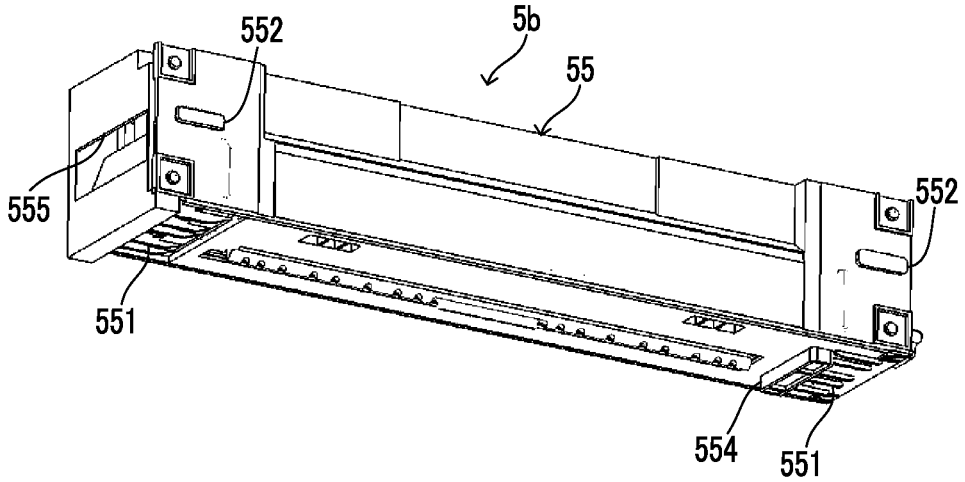
FIG. 6 is a perspective view of a fixing unit in the image forming apparatus according to the embodiment.

In addition, the second support body 55 has a plurality of strut contact portions 552 projecting toward the two struts 11 (see FIG. 4 and FIG. 6). The strut contact portions 552 come into contact with side surfaces of the two struts 11.

The interlocking mechanism 6 moves the heating unit 5*a* along the second direction D2 in conjunction with the movement of the cover member 102.

When the cover member 102 is moved from the closed position to the open position, the interlocking mechanism 6 moves the first support body 54 of the heating unit 5*a* from a reference position to a retracted position (see FIG. 4 and FIG. 5).

The reference position is the position of the first support body 54 when the first support body 54 is in contact with the second support body 55. The retracted position is the position of the first support body 54 when the first support body 54 is separated from the second support body 55.

When the first support body 54 is moved from the reference position to the retracted position, the four second fitting portions 553 are separated from the four first fitting portions 542 (see FIG. 5).

It is noted that the first support body 54 being at the reference position is synonymous with the heating unit 5*a* being at the reference position. In addition, the first support body 54 being at the retracted position is synonymous with the heating unit 5*a* being at the retracted position.

When the first support body 54 is at the retracted position, the fixing unit 5*b* can be pulled out from the main body frame 1*x* in a removal direction D11 along the first direction D1 (see FIG. 8).

When the fixing unit 5*b* is pulled out from the main body frame 1*x*, the fixing unit 5*b* can pass through the opening portion 101 of the exterior member 100.

Meanwhile, when the cover member 102 is moved from the open position to the closed position, the interlocking mechanism 6 moves the first support body 54 from the retracted position to the reference position (see FIG. 7 and FIG. 8).

When the first support body 54 is moved from the retracted position to the reference position, the four second fitting portions 553 fit into the four first fitting portions 542 (see FIG. 4).

The cover member 102 also serves as an operation portion that can be moved between a first position and a second position by being operated. The closed position of the cover member 102 is the first position of the operation portion. The open position of the cover member 102 is the second position of the operation portion.

For example, the interlocking mechanism 6 includes an action member 61, two first link members 62, a second link member 63, and a third link member 64 (see FIG. 7 and FIG. 8).

The action member 61 is disposed to be movable along the second direction D2. The two first link members 62 are coupled to the action member 61 by two first coupling shafts 611. The second link member 63 is coupled to the two first link members 62 by two second coupling shafts 621.

The third link member 64 is supported by a second support shaft 640. The third link member 64 is rotatable around the second support shaft 640. The third link member 64 is coupled to the second link member 63 by a third coupling shaft 631. The cover member 102 is coupled to the third link member 64 by a fourth coupling shaft 641.

The interlocking mechanism 6 shown in FIG. 7 and FIG. 8 is a link mechanism that converts the rotating motion of the cover member 102 into the moving motion of the action member 61 along the second direction D2.

When the cover member 102 rotates, the second link member 63 is moved along the first direction D1 by the action of the third link member 64.

When the second link member 63 moves along the first direction D1, the action member 61 is moved along the second direction D2 by the action of the first link member 62.

When the cover member 102 moves from the closed position to the open position, the interlocking mechanism 6 moves the action member 61 away from the fixing unit 5*b*. When the cover member 102 moves from the open position to the closed position, the interlocking mechanism 6 moves the action member 61 toward the fixing unit 5*b*.

The first spring 60 is disposed between the action member 61 and the first support body 54 of the heating unit 5*a* (see FIG. 4 and FIG. 5). When approaching the first support body 54 along the second direction D2, the action member 61 pushes the first spring 60 toward the first support body 54 (see FIG. 4).

When the action member 61 pushes the first spring 60 toward the first support body 54, the first spring 60 urges the first support body 54 toward the reference position.

The action member 61 has an engaging portion 612 that can engage with an engaged portion 543 of the first support body 54 (see FIG. 4). When the action member 61 moves away from the first support body 54 along the second direction D2, the engaging portion 612 engages with the engaged portion 543.

When the action member 61 moves away from the first support body 54 along the second direction D2, the first support body 54 receives force from the action member 61 through the engaging portion 612 and moves from the reference position to the retracted position (see FIG. 5).

In contrast, when the action member 61 moves toward the first support body 54 along the second direction D2, the first support body 54 receives force from the action member 61 through the first spring 60 and moves from the retracted position to the reference position (see FIG. 4).

The heating unit 5*a* and the fixing unit 5*b* are positioned in the second direction D2 by being sandwiched between the first spring 60 and the two struts 11.

It is noted that the interlocking mechanism 6 may include a gear mechanism such as a rack-and-pinion mechanism. Also in this case, the interlocking mechanism 6 converts the rotating motion of the cover member 102 into the moving motion of the action member 61 along the second direction D2.

In addition, the heating unit 5*a* and the fixing unit 5*b* are positioned in the vertical direction D3 by being placed on the two beams 12. The load of the heating unit 5*a* and the fixing unit 5*b* restricts the upward movement of the heating unit 5*a* and the fixing unit 5*b*.

Figure 12:
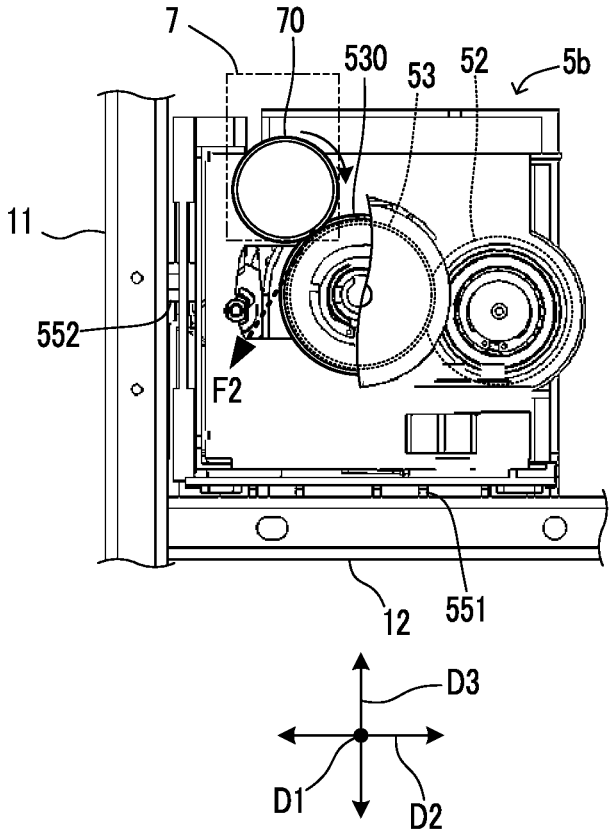
FIG. 12 shows the back of the fixing unit and a drive mechanism in the image forming apparatus according to the embodiment.

As shown in FIG. 12, the image forming apparatus 10 includes a drive mechanism 7 having a drive gear 70. The drive mechanism 7 includes a motor (not shown). The drive mechanism 7 transmits rotational force to the fixing unit 5*b* through the drive gear 70.

The fixing unit 5*b* includes a driven gear 530 that meshes with the drive gear 70. The driven gear 530 transmits the rotational force received from the drive gear 70 to the fixing roller 520. Thus, the fixing member 52 rotates. That is, the driven gear 530 transmits the rotational force to the fixing belt 52 via the fixing roller 520.

The pressure roller 53 rotates in conjunction with the rotating fixing belt 52. It is noted that the driven gear 530 is also a gear that transmits the rotational force to the pressure roller 53 via the fixing roller 520 and the fixing belt 52.

The direction of pressure F2 that the teeth of the driven gear 530 receive from the teeth of the drive gear 70 is obliquely downward toward the two struts 11. Therefore, the pressure F2 that the teeth of the driven gear 530 receive from the teeth of the drive gear 70 acts as force that urges the fixing unit 5*b* toward the two struts 11 and the two beams 12.

The fixing unit 5*b* is more firmly positioned in the second direction D2 and the vertical direction D3 by the pressure F2 received from the drive gear 70. In addition, the heating unit 5*a* is firmly positioned in the vertical direction D3 together with the fixing unit 5*b* by the action of the first fitting portions 542 and the second fitting portions 553.

In the present embodiment, the drive mechanism 7 also serves as a downward urging mechanism that urges the fixing unit 5*b* downward.

In addition, the image forming apparatus 10 further includes a cover urging mechanism 8 attached to the inner surface of the cover member 102 (see FIG. 7 and FIG. 8). In addition, the second support body 55 of the fixing unit 5*b* has a beam contact portion 554 projecting downward from the lower surface (see FIG. 4, FIG. 5, FIG. 6, and FIG. 9).

The cover urging mechanism 8 includes a second spring 80, a spring case 81, and a cap 82 (see FIG. 7).

The spring case 81 houses the second spring 80. The cap 82 is movably attached to the spring case 81. The second spring 80 is an example of an elastic fixing unit urging member.

The second spring 80 is sandwiched between the cover member 102 and the second support body 55 of the fixing unit 5*b* when the cover member 102 is in the closed position. In the present embodiment, the second spring 80 and the cap 82 are sandwiched between the cover member 102 and the second support body 55.

When the second spring 80 is sandwiched between the cover member 102 and the second support body 55, the second spring 80 urges the second support body 55 in a mounting direction D12 with elastic force (see FIG. 7). The mounting direction D12 is the opposite direction of the removal direction D11.

The force received by the second support body 55 from the second spring 80 when the cover member 102 is in the closed position brings the beam contact portion 554 into contact with a side surface of one of the two beams 12. In the present embodiment, the beam contact portion 554 comes into contact with a side surface of the second beam 12*b*.

The fixing unit 5*b* is positioned in the first direction D1 by the action of the second spring 80 and the beam contact portion 554.

It is noted that the cover urging mechanism 8 may be attached to the second support body 55 of the fixing unit 5*b*.

Figure 10:
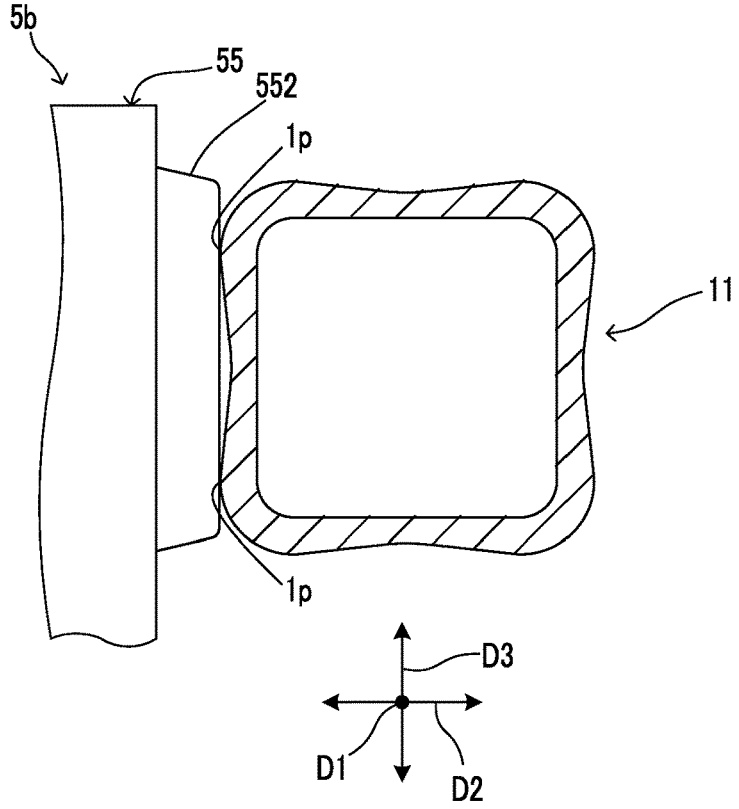
FIG. 10 shows a cross section of a strut and a lateral contact portion of the fixing unit in the image forming apparatus according to the embodiment.

In addition, each of the struts 11 has side surfaces on four sides. The four side surfaces of each of the struts 11 each have two raised portions 1*p* forming ridge lines along the longitudinal direction of the strut 11 (see FIG. 10).

The strut contact portions 552 of the second support body 55 are each brought into contact with the two raised portions 1*p* of the corresponding one of the two struts 11. Thus, the fixing unit 5*b* is stably positioned in the second direction D2.

Figure 11:
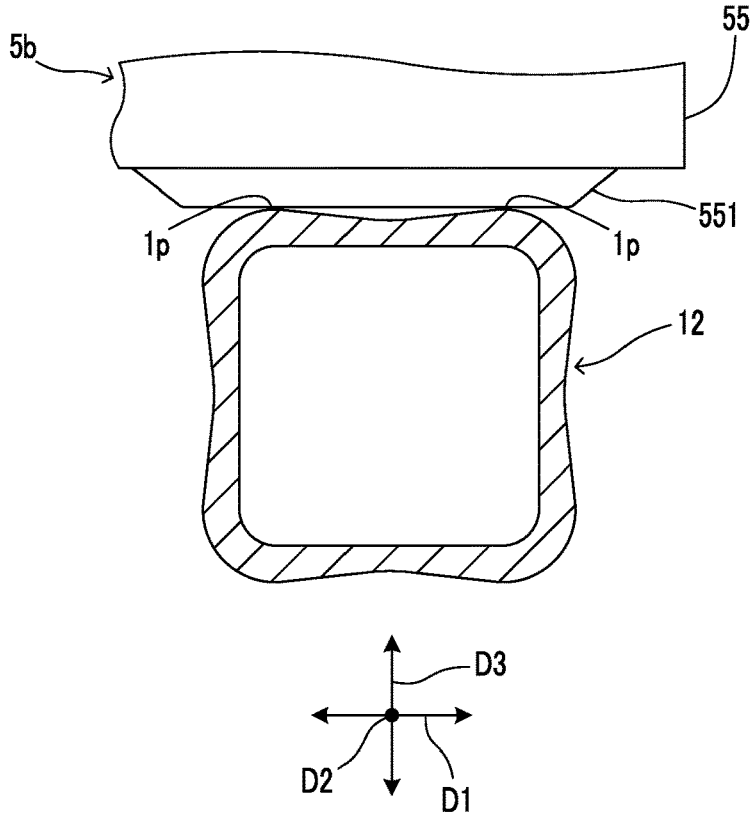
FIG. 11 shows a cross section of a beam and a lower contact portion of the fixing unit in the image forming apparatus according to the embodiment.

Similarly, each of the beams 12 also has side surfaces on four sides. The four side surfaces of each of the bream 12 each have two raised portions 1*p* forming ridge lines along the longitudinal direction of the bream 12 (see FIG. 11).

The ribs 551 of the second support body 55 are each in contact with the two raised portions 1*p* of the corresponding one of the two breams 12. Thus, the fixing unit 5*b* is stably positioned in the vertical direction D3.

By employing the image forming apparatus 10, the positioning mechanism for disposing the heating unit 5*a* and the fixing unit 5*b* at desired positions can be realized by a simple mechanism.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a main body frame;

a heating unit supported by the main body frame; and a fixing unit disposed next to the heating unit and supported by the main body frame, wherein the main body frame includes:

two struts extending in a vertical direction beside the fixing unit and spaced apart from each other in a first direction; and two beams extending in a lateral direction below the heating unit and the fixing unit, spaced apart from each other in the first direction, and coupled to the two struts, respectively, the fixing unit is disposed between the heating unit and the two struts, and the heating unit includes:

a heater; and a first support body configured to support the heater and placed on the two beams in a state of being bridged over the two beams, the fixing unit includes:

a fixing member heated by the heater;

a pressure member configured to urge a sheet toward the fixing member; and a second support body configured to support the fixing member and the pressure member and placed on the two beams in a state of being bridged over the two beams, the image forming apparatus further includes:

an elastic heating unit urging member configured to urge the first support body toward the second support body with elastic force so as to bring the first support body into contact with the second support body and bring the second support body into contact with the two struts;

an operation portion movable between a first position and a second position by being operated; and an interlocking mechanism configured to move the heating unit along a second direction, which is a direction in which the heating unit and the fixing unit are arranged, in conjunction with movement of the operation portion, the interlocking mechanism moves the first support body from a reference position where the first support body is in contact with the second support body to a retracted position where the first support body is separated from the second support body when the operation portion moves from the first position to the second position, the interlocking mechanism moves the first support body member from the retracted position to the reference position when the operation portion moves from the second position to the first position, and the fixing unit is allowed to be pulled out from the main body frame in a removal direction along the first direction when the first support body is at the retracted position.

2. The image forming apparatus according to claim 1, wherein one of the first support body and the second support body includes a concave first fitting portion which opens laterally, another one of the first support body and the second support body includes a convex second fitting portion configured to fit into the first fitting portion when the first support body moves from the retracted position to the reference position, and relative movement of the first support body and the second support body in the vertical direction is restricted by the second fitting portion fitting into the first fitting portion.

3. The image forming apparatus according to claim 1, further comprising:

an exterior member covering the main body frame, wherein the exterior member includes:

an opening portion configured to allow the fixing unit pulled out from the main body frame to pass therethrough; and a cover portion rotatable between a closed position to close the opening portion and an open position to open the opening portion, the cover portion serves also as the operation portion, the closed position of the cover portion is the first position of the operation portion, and the open position of the cover portion is the second position of the operation portion.

4. The image forming apparatus according to claim 3, further comprising:

an elastic fixing unit urging member supported by the cover portion or the fixing unit and interposed between the cover portion and the fixing unit when the cover portion is in the closed position to urge the second support body in a mounting direction opposite to the removal direction with elastic force, wherein the second support body includes a beam contact portion brought into contact with a side surface of one of the two beams by force received from the fixing unit urging member when the cover portion is in the closed position.

5. The image forming apparatus according to claim 1, further comprising a downward urging mechanism configured to urge the fixing unit downward.

6. The image forming apparatus according to claim 5, further comprising:

a drive mechanism including a drive gear and configured to transmit rotational force to the fixing unit through the drive gear, wherein the fixing unit includes a driven gear configured to mesh with the drive gear and transmit the rotational force received from the drive gear to the fixing member or the pressure member, and the drive mechanism also serves as the downward urging mechanism.

7. The image forming apparatus according to claim 1, wherein the heater is an electromagnetic induction heating device.

* * * * *